United States Patent [19]

Kvapil et al.

[11] 4,162,808

[45] Jul. 31, 1979

[54] IN-SITU RETORTING OF CARBONACEOUS DEPOSITS

[75] Inventors: Rudolph Kvapil, Denver; K. Malcolm Clews, Littleton, both of Colo.

[73] Assignees: Gulf Oil Corporation, Pittsburgh, Pa.; Standard Oil Company (Indiana), Chicago, Ill.

[21] Appl. No.: 908,798

[22] Filed: May 23, 1978

[51] Int. Cl.[2] ..... E21C 41/12

[52] U.S. Cl. ..... 299/2; 166/259

[58] Field of Search ..... 299/2; 166/259; 175/12

[56] References Cited

U.S. PATENT DOCUMENTS

| | | | |
|---|---|---|---|
| 3,349,848 | 10/1967 | Burgh | 166/259 |
| 3,917,344 | 11/1975 | Janssen et al. | 299/2 |
| 3,950,029 | 4/1976 | Timmins | 299/2 |

*Primary Examiner*—Ernest R. Purser

[57] ABSTRACT

A method of producing fluid fuels from carbonaceous deposits such as oil shale, heavy oils and coal by in-situ retorting of the carbonaceous deposit in rubblized in-situ retorts utilizes a plurality of such retorts. The retorts are subjected to a sequence of preparation for rubblization, rubblization and combustion of carbonaceous material to supply heat to produce a fluid fuel from kerogen in the carbonaceous deposit. At least one completely rubblized retort is maintained throughout its entire volume under the inlet pressure of the combustion air between retorts in which rubblization or stopping is taking place and retorts in which the combustion of the carbonaceous deposit is proceeding to prevent flow of toxic gases from the retort in which combustion is proceeding to a retort in which preparation for rubblization and rubblization are occurring. The invention is described in detail for the recovery of shale oil from oil shale deposits.

13 Claims, 3 Drawings

IN-SITU RETORTING OF CARBONACEOUS DEPOSITS

BACKGROUND OF THE INVENTION

1. Field of the Invention

This invention relates to the in-situ retorting of carbonaceous deposits to produce fluid fuels, and more particularly to an improved method of producing such fuels in which danger of exposing workers to toxic gases is minimized.

2. Description of the Prior Art

Immense potential sources of carbon-containing compounds suitable as fluid fuels exist in subsurface carbonaceous deposits of oil shale, coal, and heavy, highly viscous petroleum oils. The highly viscous petroleum oil deposits are frequently referred to as tar sands. Because the carbonaceous material in the deposits is either solid as in oil shale and coal or highly viscous as in tar sands, treatment of the carbonaceous deposit to make the carbon-containing compounds fluid is necessary to deliver them from the deposit to the surface. A method of treatment that has been used is to heat the deposit to a temperature at which fluid carbon-containing compounds are formed or the viscosity of heavy oils is drastically reduced. One method of heating the deposit is by in-situ combustion in which a portion of the carboniferous material in the deposit is burned in place by igniting the deposit and injecting air into the deposit to heat oil shale or tar sands to a temperature at which oils of low viscosity are produced or to produce combustible gaseous products from coal.

The very low permeability of oil shale to the flow of fluids makes it necessary to rubblize the shale to form an in-situ retort through which fluids for heating the shale to a temperature high enough to convert the kerogen to shale oil can be circulated. While sometimes coal and tar sands may be sufficiently permeable for an in-situ combustion process, rubblization of those deposits can be advantageous in reducing channeling through the deposits. One of the methods of forming an in-situ retort is described in U.S. Pat. No. 1,919,636 of Karrick. In the process described in that patent, a vertical central shaft is driven through the oil shale to provide the desired void space necessary for permeability and the oil shale is blasted from the walls of the shaft to fill the shaft with broken oil shale. Other mining procedures for forming a rubblized in-situ retort are described in U.S. Pat. Nos. 2,481,051 of Uren, 3,001,776 of Van Poollen and 3,661,423 of Garrett. Those patents suggest using various mining techniques such as sublevel stoping, sublevel caving, block caving and shrinkage stoping to form the in-situ retort.

It is necessary during the in-situ retorting of oil shale to introduce the combustion air into the retort at a pressure substantially above atmospheric pressure to force the air through the retort at a rate high enough to maintain combustion of oil shale in the retort. The large volume of gases that must pass through the retort and the height of the retort cause a substantial pressure drop in the gases as they travel from the combustion air inlet preferably at the top of the retort to the outlet of the retort at its lower end. If it were attempted to maintain subatmospheric pressure in retorts during the burning of oil shale, the volume of the gases drawn from the retort would be excessive.

It is likely that there will be fractures in the oil shale formation that extend outwardly from rubblized retorts.

The fractures will in many instances be naturally occurring fractures in the formation that existed before the retort was constructed but may also be fractures formed during the rubblization. Since retorts are maintained at substantially atmospheric pressure while being prepared for rubblization and during the rubblization, there is danger of flow of gases from a retort that is in the process of retorting oil shale to retorts that are being prepared for rubblization or are in the process of being rubblized. Gases developed during the retorting are highly toxic and may develop explosive mixtures when mixed with air.

SUMMARY OF THE INVENTION

This invention resides in a method of producing fluid fuels by in-situ retorting of carbonaceous deposits in rubblized subsurface retorts in which a row of retorts is formed and the carbonaceous deposit is ignited successively in the retorts beginning in the retort at one end of the row and progressing toward the other end of the row. At least one completely rubblized retort exists at all times between a retort in which combustion is occurring and a retort in which rubblization or preparation of a retort for rubblization is occurring. The intervening rubblized retort is maintained at a pressure at least as high as the pressure at the inlet end of retorts in which combustion is proceeding.

DESCRIPTION OF PREFERRED EMBODIMENT

For purposes of illustration, a preferred embodiment of this invention is described for the recovery of shale oil from oil shale deposits.

Figure 1:
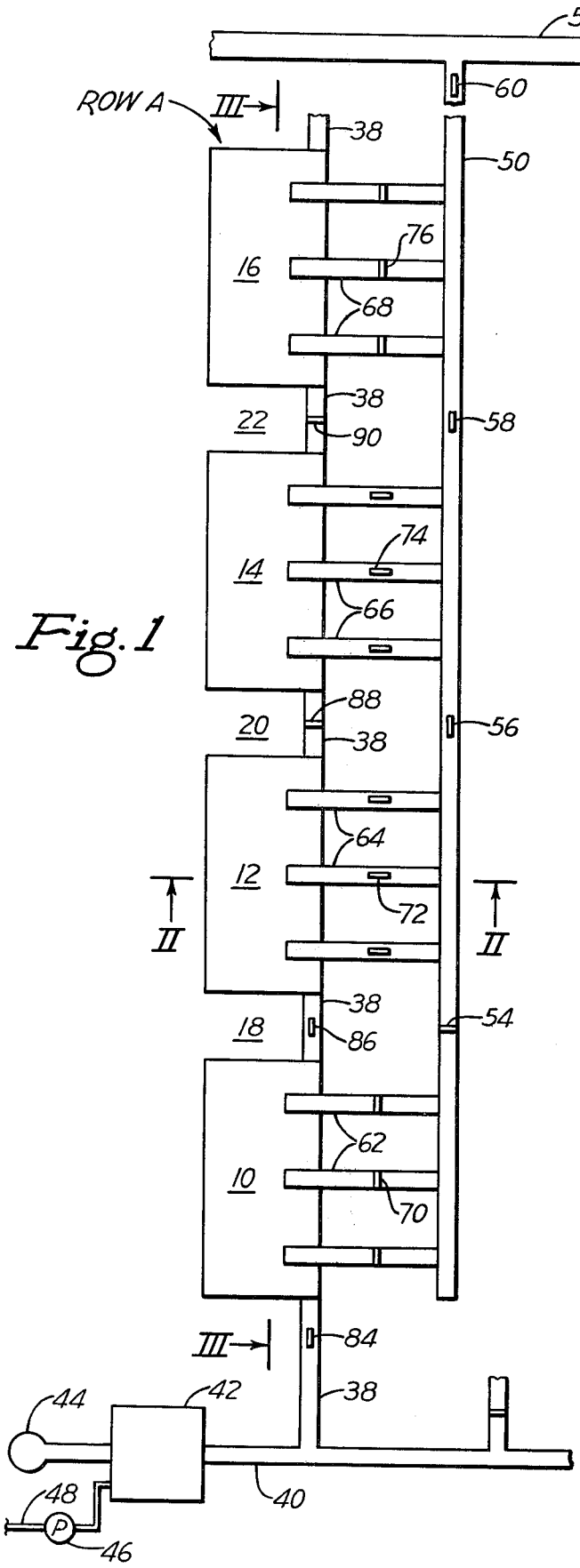
FIG. 1 is a schematic plan view of a portion of an array of retorts in a subsurface oil shale deposit.

Referring to FIG. 1 of the drawings, a plurality of retorts 10, 12, 14 and 16 in a subsurface oil shale deposit are arranged in a row designated as row A. The retorts shown are of rectangular shape and horizontal cross section and are arranged end to end with the adjacent retorts separated by end pillars 18, 20 and 22. While only four retorts have been shown in row A in FIG. 1 to simplify the drawings, it is contemplated that a row of retorts will include more than four retorts, four retorts being adequate for a description of this invention.

Figure 2:
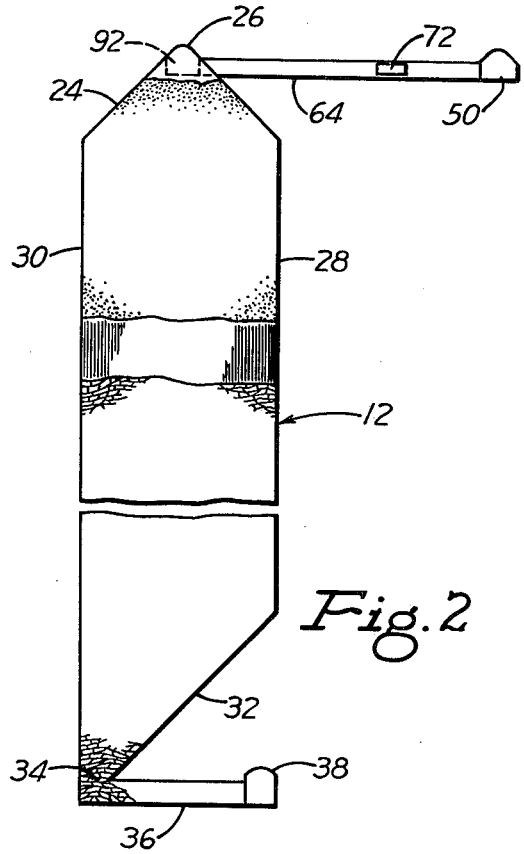
FIG. 2 is a transverse vertical sectional view taken along section line II—II in FIG. 1.

As is shown in FIG. 2, the retorts may have a height that substantially exceeds their lateral dimensions. The height will depend upon the thickness of the shale deposits in which the retorts are constructed. In a typical installation in the shale deposits in Rio Blanco County, Colo., the retorts may have a width of 100 to 150 feet, a length of 100 to 300 feet, and a height of 400 to 750 feet. The end pillars will have a thickness in the range of 60 to 125 feet. The dimensions given are merely typical of a suitable retort design in a particular formation. This invention is not restricted to use in retorts of rectangular cross section or to retorts having any particular ratio of height to width or length.

Again referring to FIG. 2, a preferred retort structure is shown in which the ceiling 24 of the retort slopes downwardly from a peak 26 at an angle preferably in the range of 40° to 55° to intersect sidewalls 28 and 30 at their upper ends. Sidewall 30 extends substantially vertically downward to the lower end of the retort. Sidewall 28 intersects at its lower end the upper end of a sloping bottom 32 of the retort. Bottom 32 slopes at an angle of 40° to 50° from sidewall 28 to an outlet 34 adjacent sidewall 30 that extends longitudinally along the bottom of the retort for its full length. A plurality of product drifts 36 extend transversely from the outlet 34 below the bottom 32 of the retort and intersect an exhaust tunnel 38.

Figure 3:
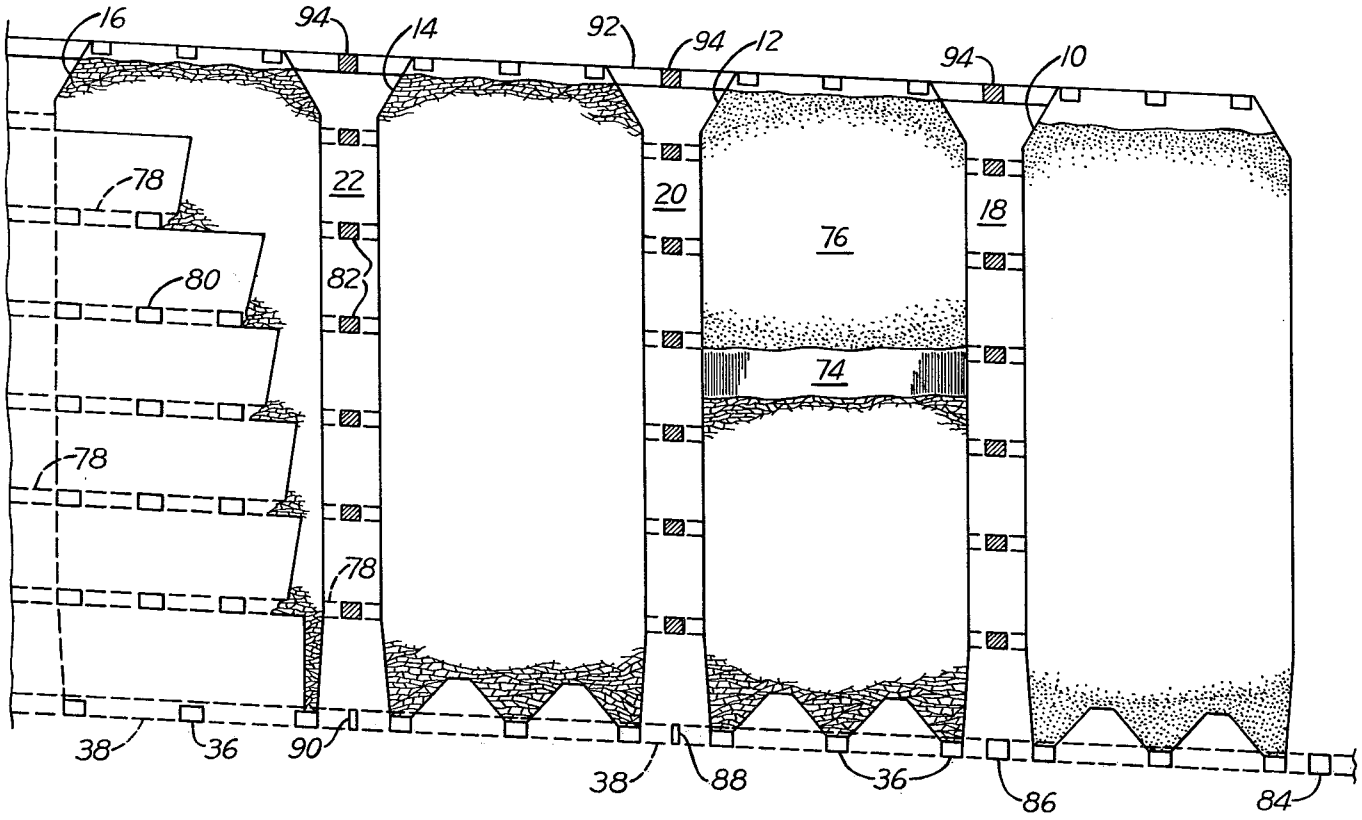
FIG. 3 is a longitudinal vertical sectional view taken along section line III—III in FIG. 1.

Referring to FIG. 1, exhaust tunnel 38 extends for the full length of the row of retorts. It extends beyond retort 10 to open into a collection tunnel 40 for the delivery of products into a separator 42 in which gaseous products are separated from liquid products. It is preferred that tunnel 38 extend downdip, as shown in FIG. 3, at a slope of 3° to 10° to facilitate flow of liquid products to the collection tunnel. Separator 42 is connected with a shaft 44 for delivery of gaseous products to the surface. For a retort of the size described above, shaft 44 preferably has a cross-sectional area of about 400 sq. ft. An exhaust fan may be installed in shaft 44 to reduce the pressure at the outlet of the retorts during the retorting phase. Liquid products from separator 42 are pumped by pump 46 through a line 48 to the surface.

Running parallel to the retorts in row A at the elevation of the top of the retorts is an apex drift 50. Apex drift 50 is connected to a combustion air tunnel 52 which in turn is connected with a combustion air shaft 53 for delivery of compressed air from compressors, not shown, at the ground surface. Installed in the apex drift 50 in alignment with the pillars 18, 20, etc. are remote-controlled combustion air control doors 54, 56 and 58. There is also a remote-controlled air control door 60 adjacent the intersection of apex drift 50 and combustion air tunnel 52. A plurality of cross drifts extend from the apex drift 50 to each of the retorts in row A. Cross drifts open into the retorts just below the crown 26 as is best illustrated in FIG. 2. The cross drifts opening into retort 10 are indicated by reference numeral 62, into retort 12 by reference numeral 64, into retort 14 by reference numeral 66, and into retort 16 by reference numeral 68. Remote-controlled combustion air control doors are installed in each of the cross drifts. The combustion air control doors in cross drifts 62 are indicated by reference numeral 70, in cross drifts 64 by reference numeral 72, in cross drifts 66 by reference numeral 74, and in cross drifts 68 by reference numeral 76.

The retorts are subjected to the sequence of preparation for rubblizing, rubblizing and retorting steps, as is best illustrated in FIG. 3 of the drawings. Rubblization of the retorts can be accomplished by any desirable technique such as those described in the Karrick, Van Poollen and Uren patents. A preferred method is sublevel caving such as is shown in retort 16 in FIG. 3. Withdrawal drifts 78 and mining drifts 80 are driven in the retorts for use in the sublevel caving operation. Withdrawal drifts 78 extend through the end pillars but are sealed as indicated by reference numeral 82 in FIG. 3 after rubblization is completed. The desired permeability is obtained by withdrawing 10 to 30 percent of the shale to provide void space for the rubblization.

The final step in the sequence of operations in the retorts is the retorting of the oil shale. Retorting is preferably accomplished by the burning of a fuel in the upper end of the retorts to heat oil shale in that portion of the retort to a temperature at which ignition occurs. Injection of combustion air into the upper end of the retort is continued after ignition to cause carbonaceous residue on the oil shale to burn and form hot combustion products. The hot combustion products travel downwardly ahead of the combustion zone to convert kerogen in the oil shale below the combustion zone to shale oil which drains from the bottom of the retorts. Conversion of kerogen to shale oil leaves a carbonaceous deposit on the shale. The carbonaceous deposit serves as the fuel that is burned in the combustion zone. As combustion proceeds, the combustion zone travels downwardly through the retorts until retorting is complete.

Referring to FIG. 3, retort 10 is shown after combustion has been completed in that retort. Retort 12 is shown as combustion is occurring in the retort with the combustion zone 74 underlying a spent shale zone 76. Below the combustion zone is rubblized shale which will be virtually devoid of shale oil immediately below the combustion zone 74 and may be practically raw shale at the bottom of the retort. Retort 14 is completely rubblized and retort 16 is in the process of being rubblized. In the exhaust tunnel 38 between retort 10 and the collection tunnel 40 is a door 84 that is open to allow products from the retort to flow to the collection tunnel. A similar door 86, also open, in exhaust tunnel 38 allows flow from retort 12 to the collection tunnel, and a door 88 in exhaust tunnel 38 between retorts 14 and 12 is closed to isolate the rubblized retort 14 from retort 12. A door 90 in exhaust tunnel 38 between retort 14 and retort 16 isolates retort 14 from retort 16 in which rubblization is taking place. All of doors 84, 86, 88 and 90 are remote controlled. They could be replaced by a pair of remote controlled doors spaced apart the length of a retort that could be moved in the exhaust tunnel updip to isolate a rubblized retort from the adjacent downdip retort being retorted and updip retort being rubblized as combustion progresses through the retorts in row A from retort 10 to retort 16. Seals 82 in the withdrawal drifts 78 prevent flow from the rubblized retort 14 to adjacent retorts through the withdrawal drifts. The mining drifts 80 do not extend beyond the sides of the retorts.

It is preferred that an apex drift 92, similar to apex drift 50, extend longitudinally of row A and form the crown of the retorts in the row to improve the control of the shape of the upper end of the retort and facilitate the mining operations. The apex drift 92 is sealed at 94 where it extends through the end pillars separating the retorts upon completion of the rubblization of the retorts. Thus, as shown in FIG. 3, apex drift 92 has not been sealed at the updip or left-hand end of retort 16.

Upon completion of the retorting in retort 10, rubblization of retort 14 will have been completed. Door 54 in apex drift 50 will be closed as will doors 70 in cross drifts 62 to prevent further flow of combustion air into retort 10. Doors 74 in cross drifts 66 are opened to allow flow of combustion air into retort 14 to raise the pressure in the retort to the pressure at which combustion air is supplied through apex drift 50. Doors 88 and 90 in the exhaust tunnel 38 are closed to isolate retort 14 and prevent flow of combustion air out of the retort; thereby maintaining the entire volume of the retort at the pressure of combustion air where cross drifts 66 open into apex drift 50. Doors 72 in cross drifts 64 are open and doors 84 and 86 in the exhaust tunnel 38 are open to allow flow through retort 12. Shale in retort 12 is ignited, for example by burning a fuel in the upper end of the retort while supplying combustion air to heat the shale to a temperature at which combustion will proceed. The supply of combustion air to the retort is continued to cause the combustion front in the retort to move downwardly through the retort and convert kerogen in the shale below the combustion front to shale oil. The position of doors 72 is adjusted to control the total flow of air and its distribution to maintain a desired rate of progress of the combustion front that is uniform over the length of the retorts.

In the preferred embodiment of the invention illustrated, combustion air is supplied to the rubblized retort from apex drift 50 at a location that is upstream from the point at which combustion air is supplied to the retort 12; therefore, the isolated rubblized retort is at a pressure that will exceed slightly the pressure at the upper end of the retort in which combustion occurs. Moreover, the flow through the retort in which combustion is occurring causes a pressure drop in that retort; hence, the pressure in the rubblized retort 14 will exceed the pressure in the retort 12 a greater amount at the lower end of the retort below the combustion front where the gases in the retort 12 are most toxic.

By the time retorting is completed in retort 12, retort 16 will be completely rubblized; then at the time of ignition of shale in retort 14, retort 16 will be isolated and subjected to the pressure of the combustion air in the manner just described for retort 14. Similarly, retort 12 was isolated and maintained at the combustion air supply pressure while combustion proceeded in retort 10. Since the row will ordinarily contain more retorts than the four illustrated, the procedure is repeated progressively updip towards the combustion tunnel 52. Scheduling of the rubblizing and retorting operations may be such that retorting proceeds in more than one retort at any given time. Regardless of the number of retorts in which combustion is taking place, at least one isolated completely rubblized retort is maintained at the increased pressure between a retort in which combustion is taking place and a retort in which rubblization or stoping operations are underway.

This invention has been described for the rubblization and retorting of oil shale in a single row of retorts in an array. Ordinarily, there will be a large number of rows of retorts in an array. For example, retorts will be constructed under apex drift 50. Following the operations in row A, the doors 54, 56 and 58 can be successively closed to allow future retorts downstream of the closed valves to be isolated from the combustion air and permit rubblization operations to proceed in retorts downdip of the closed doors. The temperature of the combustion air resulting from its compression to a pressure which may be 25–40 psia will preclude mining in areas exposed to that air. By moving progressively upstream, rubblization can proceed in the adjacent row, but at no time will stoping or rubblization proceed in a retort under apex drift 50 directly opposite a retort in row A in which combustion is proceeding.

This invention maintains at least one completely rubblized retort at the pressure of the inlet pressure of combustion air to retorts between retorts in which mining activities for rubblizing shale in a retort are occurring and retorts in which combustion of shale is taking place. When combustion air is injected into the top of a retort and burning progresses downwardly through a retort, the pressure at the top of the retort in which burning occurs is only slightly less than the pressure in the rubblized retort. Because of the pressure drop inherent to flow through a rubblized zone, the pressure below the combustion zone in the retort in which burning is occurring is lower than the pressure in the rubblized retort in which there is no combustion; consequently, flow is in the direction from the rubblized retort to the burning retort. In the preferred embodiment of the invention, the retorts are arranged in parallel rows and combustion air is supplied to retorts in one row from a drift that will subsequently be incorporated in retorts in an adjacent row, and combustion in the retorts progresses in a direction opposite to the direction of the flow of combustion air through the apex drift. After completion of burning in a retort that portion of the apex drift directly opposite the completely burned retort is blocked to flow of the combustion air and rubblization proceeds under the blocked portion of the apex drift. In this manner, rubblization can proceed in the adjacent row only after retorting is completed in a directly opposite retort.

While this invention has been described with specific reference to the production of shale oil from oil shale deposits, it is also useful in the production of heavy, highly viscous petroleum from petroleum reservoirs such as tar sands of low permeability where an increase in permeability as well as reduction in the viscosity of the oil is desirable for production at acceptable rates. The procedure can also be used for the in-situ gasification of coal in rubblized retorts in coal beds, and particularly in rubblized retorts in thick coal beds such as are found in some of the western states. The term "carbonaceous deposits" is used in this specification and the claims to designate oil shale, coal and petroleum reservoirs such as tar sands containing heavy oils of high viscosity.

We claim:

1. A method of producing fluid fuels by combustion of combustible material in carbonaceous deposits in in-situ retorts comprising successively constructing in a subsurface carbonaceous deposit in-situ retorts in a row by the sequence of stoping the retorts for rubblization and rubblizing the carbonaceous material in the retorts, each of the retorts having an inlet and an outlet spaced from the inlet, successively igniting the carbonaceous deposit in each of the retorts in series beginning at the retort at one end of the row and finishing at the retort at the opposite end of the row, injecting combustion air into the inlet of a first retort in which the carbonaceous deposit has been ignited to cause a combustion front to move through the retorts toward the outlet and release a fluid fuel from the carbonaceous deposit therein, delivering the fluid fuel from the outlet of the retort in which combustion is proceeding to the surface, maintaining at least a second retort fully rubblized between the retort in which combustion is proceeding and retorts in which stoping or rubblization is proceeding, injecting combustion air into the second retort and blocking flow therefrom to maintain the entire second retort at substantially the inlet pressure of the combustion air to prevent flow of combustion products from the first retort to the second retort.

2. A method as set forth in claim 1 in which combustion air is injected into an inlet at the upper end of the retorts, shale oil is delivered from the retorts through an outlet at the lower end thereof, and a combustion front moves downwardly through the retort.

3. A method of producing shale oil as defined in claim 1 in which the first and second retorts are supplied by combustion air from a common air supply drift and the second retort is supplied from a point upstream of the point from which the first retort is supplied.

4. A method of producing shale oil as defined in claim 2 in which the first and second retorts are supplied by combustion air from a common air supply drift and the second retort is supplied from a point upstream of the point from which the first retort is supplied.

5. A method as set forth in claim 1 in which the combustion air is supplied to the first and second retorts through separate cross drifts from a single air supply drift, and controlling the rate of flow of the air to the first retort by partially closing a remote-controlled door in the cross drift to the first retort whereby the combustion air pressure at the inlet of the second retort is higher than at the inlet of the first retort.

6. A method as set forth in claim 1 in which combustion air is delivered from the surface through a combustion air tunnel extending at an angle to the row of retorts at one end of the row and at substantially the elevation of the upper end of the retorts, an apex drift extends from the combustion air tunnel parallel to the row of retorts at substantially the elevation of the upper end of the retorts in the row, the stoping, rubblization and combustion in the retorts progresses through the retorts successively beginning at the retort farthest from the combustion air tunnel and progressing toward the combustion air tunnel, and following combustion of oil shale in a retort blocking flow of combustion air to such retort and thereafter constructing a rubblized retort under the apex drift opposite the retort in which combustion is completed.

7. A method as set forth in claim 1 characterized by the carbonaceous deposit being oil shale and the fluid fuel being shale oil.

8. A method as set forth in claim 1 characterized by the carbonaceous deposit being an oil reservoir and the fluid fuel being a petroleum oil.

9. A method as set forth in claim 1 characterized by the carbonaceous deposit being coal and the fluid fuel being a gas comprising carbon monoxide as a principal combustible material.

10. In a method of producing shale oil by combustion of oil shale in in-situ retorts in a subsurface oil shale deposit in which each of a plurality of in-situ retorts is subjected to the sequence of preparation for rubblization, rubblization, and ignition of oil shale together with injection of combustion air to maintain combustion in the retort to release shale oil from kerogen, the improvement comprising maintaining between retorts in which combustion is occurring and retorts in which preparation for rubblization and rubblization is occurring at least one fully rubblized retort at substantially the pressure of the combustion air supplied to the retort in which combustion occurs to prevent leakage of combustion products from the retort in which combustion is proceeding to a retort in which preparation for rubblization or rubblization is proceeding.

11. A method for producing shale oil by combustion of oil shale in in-situ retorts as set forth in claim 2 including the steps of supplying combustion air into the at least one rubberized retort and blocking flow of combustion air from the at least one rubberized retort to thereby maintain the combustion air supply pressure in the at least one rubberized retort.

12. In a method of producing a gaseous fuel by partial combustion of coal in in-situ retorts in a subsurface coal deposit in which each of a plurality of in-situ retorts is subjected to the sequence of preparation for rubblization, rubblization, and ignition of the coal together with injection of combustion air to maintain combustion in the retort to release the gaseous fuel from the coal, the improvement comprising maintaining between retorts in which combustion is occurring and retorts in which preparation for rubblization and rubblization is occurring at least one fully rubblized retort at substantially the pressure of the combustion air supplied to the retort in which combustion occurs to prevent leakage of combustion products from the retort in which combustion is proceeding to a retort in which preparation for rubblization or rubblization is proceeding.

13. In a method of producing oil by partial combustion of oil in in-situ retorts in a subsurface petroleum reservoir in which each of a plurality of in-situ retorts is subjected to the sequence of preparation for rubblization, rubblization, and ignition of petroleum together with injection of combustion air to maintain combustion in the retort to move oil from the rubble, the improvement comprising maintaining between retorts in which combustion is occurring and retorts in which preparation for rubblization and rubblization is occurring at least one fully rubblized retort at substantially the pressure of the combustion air supplied to the retort in which combustion occurs to prevent leakage of combustion products from the retort in which combustion is proceeding to a retort in which preparation for rubblization or rubblization is proceeding.

* * * * *

UNITED STATES PATENT OFFICE

CERTIFICATE OF CORRECTION

Patent No. 4,162,808 Dated July 31, 1979

Inventor(s) Rudolph Kvapil and K. Malcolm Clews

It is certified that error appears in the above-identified patent and that said Letters Patent are hereby corrected as shown below:

Abstract, line 11, "stopping" should be --stoping--.

Column 8, line 10, "2" should be --10--.

Column 8, lines 12, 13, and 15, "rubberized" should be --rubblized--.

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*